US007047662B2

(12) United States Patent
Ihme et al.

(10) Patent No.: US 7,047,662 B2
(45) Date of Patent: May 23, 2006

(54) PRINTING PRESS DRYER HAVING AN EXCIMER RADIANT HEATER

(75) Inventors: Andreas Ihme, Goldbach (DE); Axel Sobottka, Leipzig (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 103 days.

(21) Appl. No.: 10/729,797

(22) Filed: Dec. 5, 2003

(65) Prior Publication Data

US 2004/0168596 A1 Sep. 2, 2004

(30) Foreign Application Priority Data

Dec. 6, 2002 (DE) ..... 202 18 908 U

(51) Int. Cl.
*F26B 3/34* (2006.01)

(52) U.S. Cl. ..... 34/266; 34/273

(58) Field of Classification Search ..... 101/424.1, 101/487, 488; 34/266, 273; 392/424
See application file for complete search history.

(56) References Cited

U.S. PATENT DOCUMENTS 4,727,655 A * 3/1988 Jacobi, Jr. ..... 34/266
5,761,377 A * 6/1998 Wolfe et al. ..... 392/376
6,058,621 A * 5/2000 Piccinino et al. ..... 34/273

FOREIGN PATENT DOCUMENTS

GB 2096294 A * 10/1982
JP 60015189 A * 1/1985

* cited by examiner

*Primary Examiner*—Kenneth Rinehart
(74) *Attorney, Agent, or Firm*—Leydig, Voit & Mayer, Ltd.

(57) ABSTRACT

A printing press dryer having an excimer radiant heater adapted for high energy output and compact mounting within the printing press. The heater includes a housing (1) within which a plurality of radiant tubes (2,3) are arranged in parallel relation to each other, and the radiant tubes (2,2) each have a respective adjacent reflector section (4,5) for directing a predetermined radiation distribution on passing printed sheet material.

3 Claims, 1 Drawing Sheet

PRINTING PRESS DRYER HAVING AN EXCIMER RADIANT HEATER

FIELD OF THE INVENTION

The present invention relates generally to printing presses, and more particularly to printing press dryers having excimer radiant heaters for drying printed sheet material directed through the printing press.

BACKGROUND OF THE INVENTION

In sheet-fed offset printing presses, the printed sheets are conveyed through individual printing units over cylinders and drums and, after the last printing unit, through one or more varnishing and other finishing devices. The sheets are transported from a last drum to the delivery stack by chain systems. In order to prevent smearing of the freshly printed sheets during transport between the printing units, between the last printing unit and the delivery stack or the varnishing devices, dryer devices are provided at a various locations along the path of travel.

During the printing of UV inks, UV radiant heaters and, in particular, excimer radiant heaters are used as dryers. The intensity and distribution of UV radiation aimed at the printed side of the sheets is designed such that complete curing of the inks is achieved even at maximum printing speed. Incomplete curing of the ink can cause sheet damage and rejection in the event of contact between the sheet and sheet guide devices or the delivery stack. Excimer radiant heaters for sheet-fed offset presses are known, for example, from EP 378 826 A2, DE 198 57 984 A1 and EP 891 525 B1.

The radiation produced in excimer radiant heaters which have a tubular design is highly divergent. The reason for this is that the discharge chamber has a circular cross section, formed by inner and outer tubes located in the space that accommodates the dielectric. While flat radiant heaters with rectangular reflector irradiation outputs are known, they are useful only at close spacing to the passing steel material, such as at a spacing of a few millimetres. The UV intensity, however, decreases sharply with increasing distance for the sheet material.

In the case of sheet-fed offset presses, the distance between radiant heaters and the printing-material plane is in the range of a few centimeters due to technical reasons and the make-up of the press. In addition, dryer installation space often is limited. In order to achieve useful radiation intensities, the radiation has to be directed distance on to the passing sheets.

The UV radiant heater according to EP 891 525 B1 has a tube extending over the format width of the machine as a radiation generator, which interacts with a reflector arranged in a housing. The radiation generated by the tube is deflected onto the printed material in a directed manner. In high-speed sheet-fed presses that print with UV ink, a high radiant output must be achieved in the region of the printed sheet irradiated by the excimer radiant heater. For the complete curing of the printing inks, a plurality of individual radiant heaters often are arranged one after another if there is appropriate installation space in the printing press.

OBJECTS AND SUMMARY OF THE INVENTION

It is an object of the present invention to provide a printing press dryer having an excimer radiant heater adapted for high energy output and compact mounting within the printing press.

In carrying out the invention, an excimer radiant heater is provided that as a plurality of excimer radiant tubes arranged in parallel relation to each other in a housing, with each tube having an associated reflector for directing radiation toward passing sheet material. Such an excimer heater is compact in design and is operable for more effective focusing of high radiation on the sheet material. The heater preferably has two excimer radiant tubes, and the reflectors associated with the excimer radiant tubes preferably are in parabolic form.

The parallel arrangement of two radiant tubes in a housing with associated reflector parts or sections, preferably parts or sections of a common reflector, results in optimum irradiation of printing material at respective predetermined distances of the radiant tubes from the passing sheet material. In a preferred embodiment, the parabolic shaped reflector sections of the common reflector define closed bottom joint intermediate walls between adjacent radiant tubes that extend below the upper periphery of the radiant tubes, but not below a lower periphery thereof, and the reflector sections at upstream and downstream ends each have an end wall that extends to a level below the level of radiant tubes and faces in respective downstream and upstream directions. The parabolic shaped reflector sections also have central axes 4A, 5B that are inclined at an acute angle $\alpha$ to each other such that the parabolic shaped reflector sections open in a direction toward each other. It will be understood by one skilled in the art that the geometry of the reflection mirrors may be calculated in accordance with the distance of the radiant tubes relative to the sheet material. The appropriate parameters in this regard include the mirror shape, the position and orientation of the radiant tubes in relation to the mirror, and the angle of inclination of the mirror elements in relation to one another.

Other objects and advantages of the invention will become apparent upon reading the following detailed description and upon reference to the drawing, in which:

DETAILED DESCRIPTION OF THE PREFERRED EMBODIMENT

Figure 1:
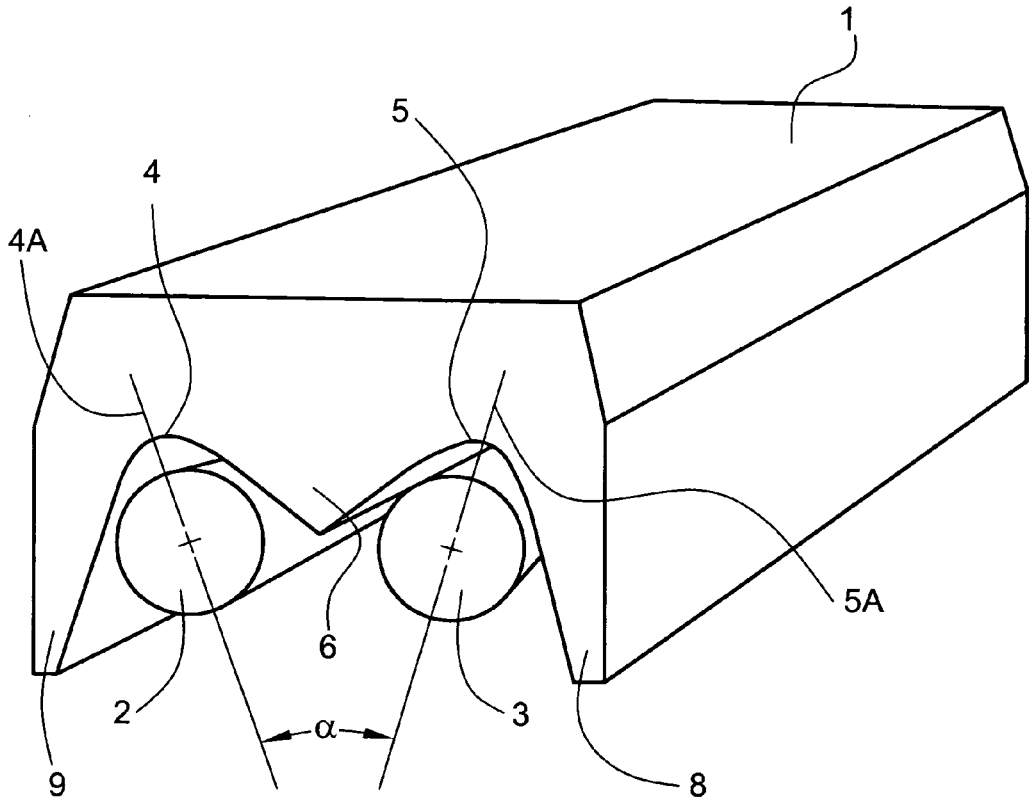
FIG. 1 is a diagrammatic perspective of a dryer for a sheet fed printing press having two radiant tubes with associated reflectors in accordance with the invention.

Referring now more particularly to FIG. 1 of the drawings, there is shown a illustrative dryer for a printing press, such as sheet fed printing presses, which comprises a radiant heater in accordance with the invention. The illustrated radiant heater includes a housing 1 within which two radiant tubes 2,3 are arranged in parallel relation to each other for directing radiation downwardly from a bottom of the housing 1, which in this case is open. The radiant tubes 2,3 are fixed at opposite ends in respective appropriate mountings.

In carrying out the invention, each radiant tube 2,3 has a respective reflector section 4,5 disposed in closely spaced adjacent relation to the tube. The arrangement and spacing of the reflector tubes as well as the spacing and configuration of the reflector sections 4,5, are calculated and configured such as to direct the required radiation intensity on passing sheet material for the particular distance of the radiant tubes from the sheet material. The reflector sections preferably are parabolic in shape and are part of a common reflector. In the preferred embodiment, parabolic shaped reflector sections 4,5 of the common reflector define a closed bottom joint intermediate wall 6 between adjacent radiant tubes 2,3, that extend below the upper periphery of the radiant tubes 2,3, but not below a lower periphery thereof, and the reflector section 5 at the upstream end of the radiant heater defines an end wall 8 that extends to a level below the level of the radiant tubes 2,3 and faces in an upstream direction. The reflector section 4 at the downstream end of the radiant heater defines an end wall 9 that also extends to a level below the level of the radiant tubes 2,3, and faces in an upstream direction. The parabolic shaped reflector sections 4,5 in this case have central axes 4A, 5B respectively, relative to their respective parabolic configurations that are inclined at an acute angle 2 to each other such that the parabolic shaped reflector section 4,5 open in a downward direction toward each other for optimum direction of irradiation onto passing printed sheet material. While the illustrated embodiment has two radiant tubes 2,3 with respective reflector sections 4,5, and it will be understood that greater numbers of radiant tubes can be provided.

The radiant tubes 2,3 and reflector sections 4,5 are disposed within the housing 1 of the heater. It can be seen that the heater has a relatively compact design which can be utilized at various locations within a sheet fed printing press. Yet, the arrangement of radiant tubes and reflector sections permit relatively high, optimally controlled irradiation of printed material for effective drying, which prevents smearing damage and rejection of the printed sheets.

What is claimed is:

1. In a printing press having at least one printing unit for printing sheet material directed through the printing press in a downstream direction of travel, a dryer for drying printed sheet material as it is directed along a predetermined path of movement following passage through said at least one printing unit, said dryer comprising a radiant heater, said radiant heater including a housing within which a pair of radiant tubes (2,3) are arranged in parallel relation to each other and in perpendicular relation to the direction of movement of sheet material along said predetermined path of movement, said radiant tubes having a common reflector supported within said housing for directing predetermined radiation onto the printed sheet material directed along said path, said reflector being formed with parallel parabolic shaped reflector sections, said radiant tubes each being disposed at least partially within a respective one of said parabolic shaped reflector sections, said parabolic shaped reflector sections defining a closed bottom joint intermediate wall between adjacent radiant tubes, and said parabolic shaped reflector sections having central axes that are inclined at an acute angle to each other such that the parabolic shaped reflector sections open in a direction toward each other.

2. In a printing press having at least one printing unit for printing sheet material directed through the printing press in a downstream direction of travel, a dryer for drying printed sheet material as it is directed along a predetermined path of movement following passage through said at least one printing unit, said dryer comprising a radiant heater, said radiant heater including a housing within which two radiant tubes are arranged in parallel relation to each other and in perpendicular relation to the direction of movement of sheet material along said predetermined path of movement, said radiant tubes having a common reflector supported within said housing for directing predetermined radiation onto the printed sheet material directed along said path, said reflector being formed with parallel parabolic shaped reflector sections, said parabolic shaped reflector sections having central axes that are inclined at an acute angle with respect to each other such that the parabolic shaped sections open in a direction toward each other, said radiant tubes each being disposed at least partially within a respective one of said parabolic shaped reflector sections, said parabolic reflector sections defining a closed bottom joint intermediate wall between adjacent radiant tubes that extends below the upper periphery of the radiant tubes but not below a lower perimeter thereof, said reflector having a reflector section at an upstream end thereof with an end wall and faces in a downstream direction that extends to a level below the level of the radiant tubes, and said reflector having a reflector section at a downstream end of said reflector with an end wall that extends to a level below the level of the radiant tubes and faces in an upstream direction.

3. In the printing press of claim 2 in which said radiant burner is spaced a distance greater than one centimeter from the sheet material directed along said predetermined path.

* * * * *